United States Patent [19]

Uccello et al.

[11] 4,366,910

[45] Jan. 4, 1983

[54] STORAGE RACK ASSEMBLY AND METHOD OF ASSEMBLING SAME

[75] Inventors: Salvatore A. Uccello, Glastonbury; Barry M. Weinbaum, Manchester, both of Conn.

[73] Assignee: Lok-Rak Corporation of America, East Hartford, Conn.

[21] Appl. No.: 201,176

[22] Filed: Oct. 27, 1980

[51] Int. Cl.[3] ..... A47F 5/10

[52] U.S. Cl. ..... 211/191; 29/526 R; 403/230

[58] Field of Search ..... 211/191, 192, 208, 207, 211/182, 187; 403/230, 315, 231, 262; 29/526 R

[56] References Cited

U.S. PATENT DOCUMENTS

| | | | |
|---|---|---|---|
| 2,932,368 | 4/1960 | Schell . | |
| 3,096,107 | 7/1963 | Farley . | |
| 3,096,108 | 7/1963 | Baybarz . | |
| 3,186,527 | 6/1965 | Konstant et al. . | |
| 3,213,978 | 10/1965 | Downes . | |
| 3,222,874 | 12/1965 | Zink . | |
| 3,295,873 | 1/1967 | Attwood . | |
| 3,638,981 | 2/1972 | Weider . | |
| 3,726,414 | 4/1973 | Konstant . | |
| 3,877,579 | 4/1975 | Weider | 211/182 X |
| 4,030,611 | 6/1977 | Konstant | 211/191 |

*Primary Examiner*—William E. Lyddane
*Assistant Examiner*—Robert W. Gibson, Jr.

[57] ABSTRACT

A storage rack has vertical posts with vertically spaced apertures. Rails extend horizontally between the posts and are locked onto them by means of mounting plates on the ends of the rails. Each mounting plate has a pair of contiguous perpendicular planar surfaces that receive the edge margin of the post in the corner that they provide. The rail extends from one of the planar portions of the mounting plate, while the other planar portion has apertures through it that are aligned with apertures through two parallel walls of the post. The free ends of the legs of a generally U-shaped connector extend through these holes and are fastened at the exterior surface of the apertured mounting-plate portion by nuts. Exteriorly of the opposite post wall, the U-shaped connector has an offset web portion that extends perpendicularly of the leg portions beyond the edge margin of the post and around a narrowed tongue portion of the mounting-plate portion from which the rail extends. The connector web portion bears against the mounting-plate tongue portion at the same time that the nuts bear against the apertured mounting-plate portion, so tightening of the nuts causes fastening force on the mounting plate in two directions.

12 Claims, 10 Drawing Figures

STORAGE RACK ASSEMBLY AND METHOD OF ASSEMBLING SAME

BACKGROUND OF THE INVENTION

The present invention relates to storage racks, and in particular to the means by which adjustable racks are held together.

It is often desirable for storage racks to be made adjustable so that loads of varying sizes can be carried, but they should also be rigid in the assembled state because they are often subjected to heavy loads and less than gentle handling. Central to any design to achieve these ends is connecting hardware that is easily removed for adjustment of the rack but that affords a high degree of strength and rididity to the rack in its assembled state. The art abounds in connectors designed to achieve these ends. Two examples of such designs are illustrated in U.S. Pat. Nos. 3,295,873 to Attwood and 3,726,414 to Konstant. As FIG. 11 of the Attwood specification illustrates, a diagonally extending connector pin forces an angle member into close abutment with two perpendicular surfaces of a post. The abutment of the angle member against both perpendicular surfaces is advantageous because it tends to limit the pivoting about the post axis of the rail attached to the angle member. This, of course, contributes rigidity to the structure. Konstant illustrates the use of a generally U-shaped member that attaches a mounting plate to a post at two positions. Of course, the connection at two positions contributes to rigidity in that it increases the force prohibiting downward movement of a rail extending from the mounting plate. However, the holding force in two directions provided by Attwood is not afforded.

It is the object of the present invention to provide the benefits of these and similar prior-art connectors while increasing rigidity and affording simplicity in hardware and assembly.

SUMMARY OF THE INVENTION

The foregoing and related objects are achieved on a storage rack including the combination of a post, rail, a mounting plate, a generally U-shaped connector, and locking means. The post has a vertically extending wall with at least one pair of vertically spaced apertures through it. The post also provides a vertical abutment surface in a plane perpendicular to that of the wall. A rail extends horizontally from the post, and the mounting plate is disposed at the end of the rail adjacent the post. The mounting plate has contiguous first and second planar portions lying in substantially perpendicular vertical planes, each planar portion having an interior surface adjacent the post and an exterior surface. The first planar mounting-plate portion has its interior surface disposed against the first wall and has a pair of apertures aligned with the pair of apertures through the post wall. The rail extends from the exterior surface of the second mounting-plate portion, and the interior surface of the second mounting-plate portion abuts the abutment surface on the post.

The generally U-shaped connector includes a pair of substantially parallel leg portions extending horizontally through the pairs of apertures in the first mounting-plate portion and the post wall. Each of the leg portions includes a locking portion at its free end that extends exteriorly of the first mounting-plate portion. The connector further includes a laterally offset web portion extending between the leg portions in a plane spaced from that of the post wall. The web portion extends substantially perpendicularly to the leg portions and beyond the abutment surface of the post to define an opening between the connector web portion and the post. The second mounting-plate portion includes a tongue portion extending into the opening defined between the post and the connector web portion. The locking means is engaged on the locking portions of the connector outwardly of the first mounting-plate portion, abuts its exterior surface, and holds the several elements in assembly. The connector web portion bears against the exterior surface of the mounting-plate tongue portion when the several elements are in assembled position. The locking means thereby causes the connector web portion to hold the mounting-plate tongue portion against the abutment surface of the post to hold the rail rigidly in position on the post.

The post typically has a second vertically extending wall substantially parallel to the first-mentioned post wall and having a pair of apertures through it that are aligned with the apertures through the first post wall and the first mounting-plate portion. The leg portions of the U-shaped connector extend through the apertures through the second post wall, and the web portion extends adjacent and exterior to the second post wall. The post may also have a vertical side wall extending substantially perpendicularly between the first and second post walls to provide the abutment surface.

In the preferrred embodiment, the locking portions of the connector are threaded, and the locking means include nut means threadedly engaging the threaded locking portions. Preferably, the connector and mounting-plate plate tongue portion are dimensioned and configured for engagement of the mounting-plate tongue portion by the connector web portion throughout a range of protrusions of the connector locking portions from the mounting-plate apertures. The force of the web portion on the mounting-plate tongue portion through at least a part of the range increases with the amount of protrusion of the locking portions of the connector from the first planar portion of the mounting plate. Tightening of the nut means within the part of the range to increase the protrusion of the connector thereby increases the force of the connector web portion on the mounting-plate tongue portion.

There is therefore also taught a method of assembling a storage rack. The method includes the step of providing an elongated post having an elongated wall with at least one pair of longitudinally spaced apertures through it. The post also provides an abutment surface in a plane substantially perpendicular to that of the wall. An elongated rail and a mounting plate at its one end are also provided. The mounting plate has contiguous first and second planar portions lying in substantially perpendicular planes. The second planar portion provides a tongue portion, and the rail extends perpendicularly in one direction from one surface of the second planar mounting-plate portion. The first planar mounting-plate portion extends in the other direction from the other surface of the second mounting-plate portion. The mounting plate is dimensioned and configured to receive the edge margin of the first post wall in the corner formed between the first and second planar mounting-plate portions with the first planar mounting-plate portion abutting the post wall and the other surface of the second planar mounting-plate portion abutting the abutment surface. The first planar mounting-plate portion includes apertures through it positioned for alignment with the apertures in the post wall when the post wall abuts the first mounting-plate portion with the post edge margin in the corner provided by the first and second planar mounting-plate portions.

A generally U-shaped connector is provided that includes a pair of substantially parallel leg portions spaced and dimensioned to extend through the pair of apertures in the post wall and to further extend through the apertures in the first mounting-plate portion to provide a locking portion of the connector exterior to the first mounting-plate portion when the first mounting-plate portion abuts the post wall with its apertures aligned with the apertures in the post wall. The connector locking portions are threaded on their exterior surfaces. The connector further includes a web portion extending between the leg portions and being laterally offset to extend, when the leg portions are received in the apertures in the post wall, beyond the abutment surface of the post to define an opening between the connector web portion and the post sized to receive the mounting-plate tongue portion in it. The rail and mounting plate are assembled on the post with the post wall and the first mounting-plate portion in abutment with their apertures aligned and with the second mounting-plate portion abutting the abutment surface. The leg portions of the connector are inserted through the apertures in the post wall and the first planar mounting-plate portion to extend the connector locking portions exteriorly of the first planar mounting-plate portion. The opening defined between the connector web portion and the post is thereby provided.

Nut means threadedly engageable with the threaded locking portions of the connectors are provided, and they are threadedly engaged on the locking portions and tightened to urge the first mounting-plate portion against the first post wall. This causes the connector web portion to bear against the tongue portion of the second planar mounting-plate portion on the surface from which the rail extends, thereby fixing the rail rigidly in position on the post. Preferably, the connector and mounting-plate tongue portion are dimensioned and configured for engagement of the mounting-plate tongue portion by the connector web portion throughout a range of protrusions of the connector locking portions from the mounting-plate aperture. The force of the web portion on the mounting-plate tongue portion through at least a part of the range increases with the amount of protrusion of the locking portions of the connector from the first planar portion of the mounting plate. The step of tightening the nut means thus includes increasing the protrusion of the connector to increase the force of the connector web portion on the mounting-plate tongue portion.

BRIEF DESCRIPTION OF THE DRAWINGS

These and further features and advantages of the present invention are described in connection with the accompanying drawings, in which.

DETAILED DESCRIPTION OF THE PREFERRED EMBODIMENT

Figure 1:
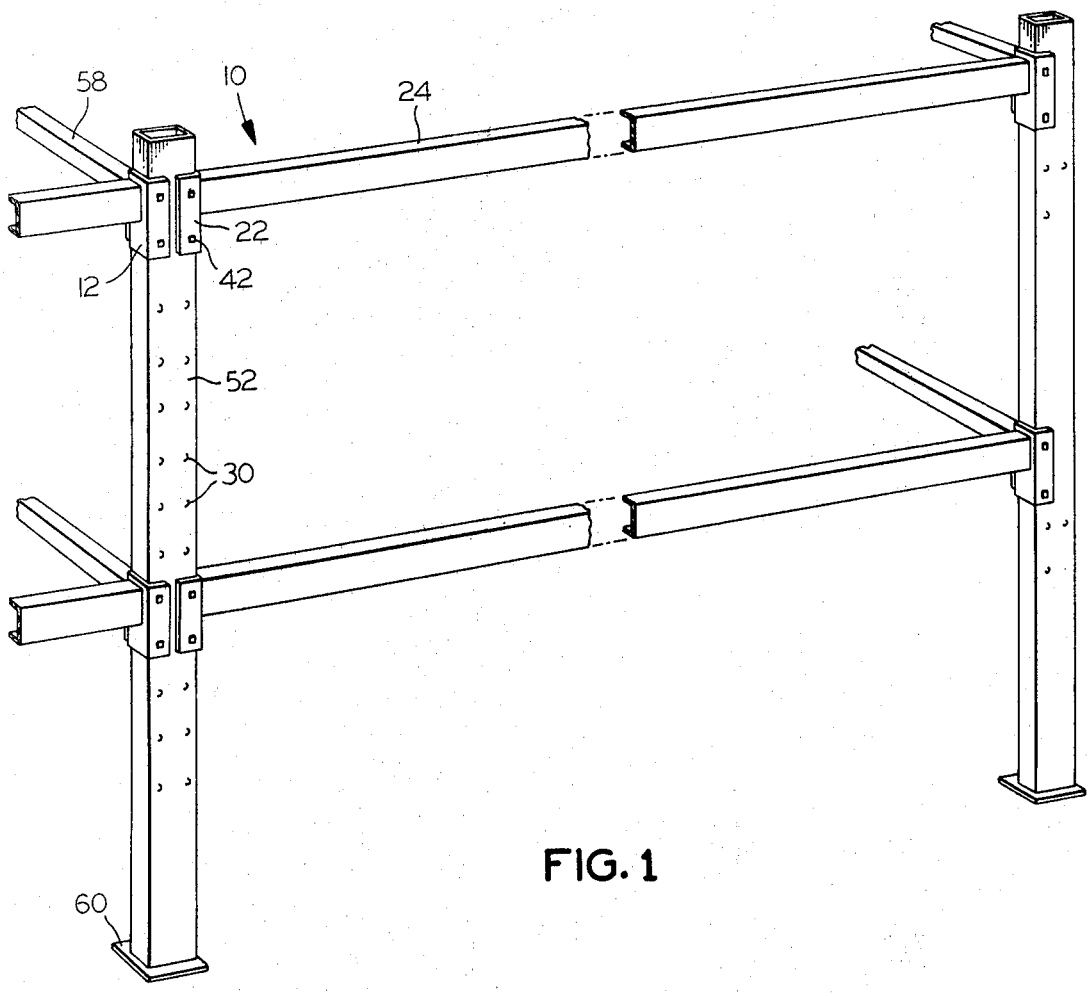
FIG. 1 is a perspective view of a portion of a storage rack employing the teachings of the present invention.
Figure 2:
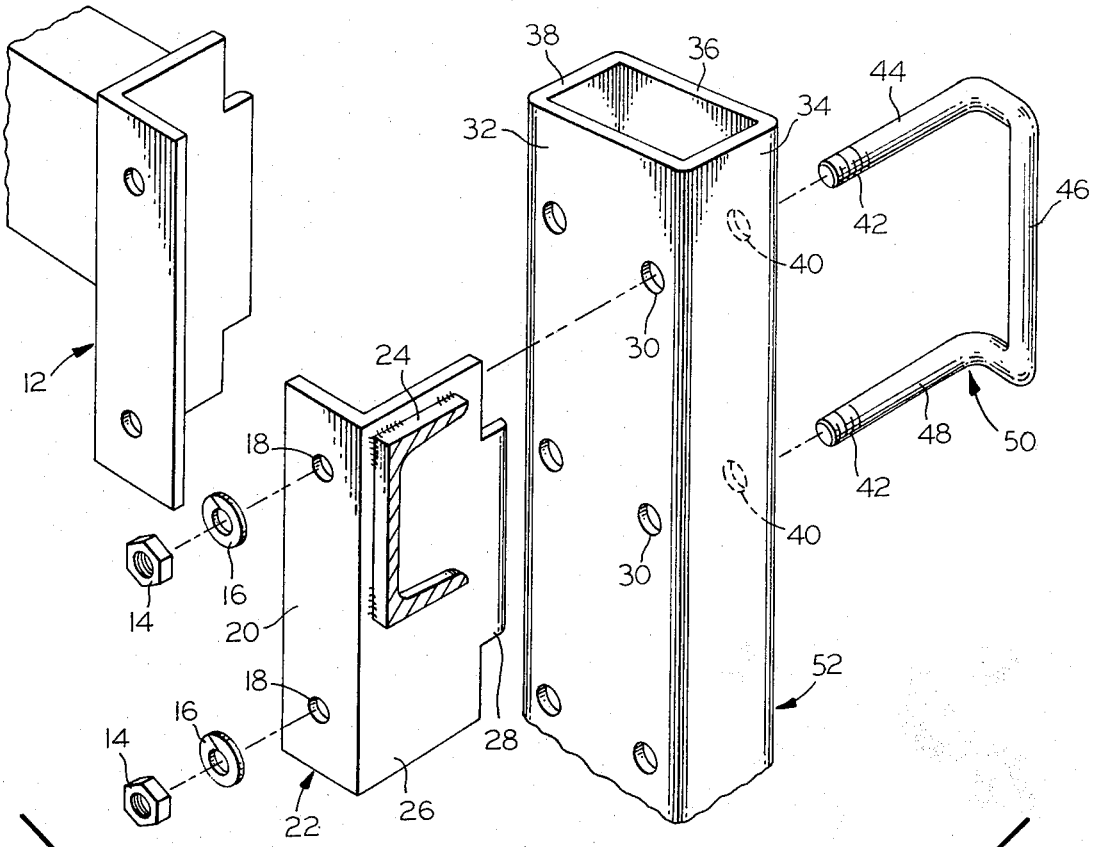
FIG. 2 is an exploded view of a portion of the rack illustrated in FIG. 1.

FIG. 1 illustrates a part of the storage rack in which the rails such as rail 24 are connected to a vertical post 52 in accordance with the teachings of the present invention. Rail 24 has a mounting plate 22 at its end. As FIG. 2 illustrates, mounting plate 22 is provided with apertures 18 aligned with similar apertures 30 and 40 in post 52. Legs 44 and 48 of a connector 50 extend through these apertures for locking by nuts 14. According to the present invention, the generally U-shaped connector has an offset web portion 46 that extends beyond the edge margin of post 52 to provide an opening into which a tongue portion 28 of mounting plate 22 extends. Tightening of nuts 14 causes a web portion 46 to bear against tongue portion 28, thereby exerting a locking force in two dimensions on mounting plate 22 and providing a particularly rigid connection of rail 24 to post 52.

A perusal of FIG. 1 reveals that the storage rack 10 illustrated in FIG. 1 includes a number of vertical posts such as post 52, each of which is provided with a foot 60 of conventional design. The storage rack is intended to be adjustable, and apertures 30 are vertically spaced along post 52 for this purpose. Rails 24 are provided at heights suited to the particular application. Mounting plates 22 at their ends have two perpendicular planar portions providing a corner into which the edge of post 52 is received. Mounting plate 22 is locked onto post 52 by connectors described in more detail below and evidenced in FIG. 1 by locking portions 42 that protrude from the exterior surface of mounting plate 22.

Front-to-rear spacing between posts may be provided by spacing rails such as rail 58. Although spacing rail 58 is illustrated as disposed in the same vertical position as that occupied by adjustable rail 24, spacing rails 58 would typically not be adjustable.

FIG. 2 illustrates in more detail the connection of the rails to the post. Left and right mounting plates 12 and 22 are both illustrated in FIG. 2, but the connector for mounting plate 12 is omitted for the sake of simplicity.

Figure 5:
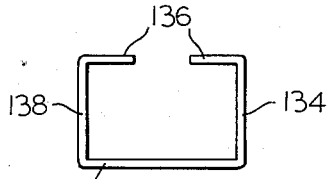
FIGS. 5, 6, and 7 are plan views of exemplary alternative posts.
Figure 6:
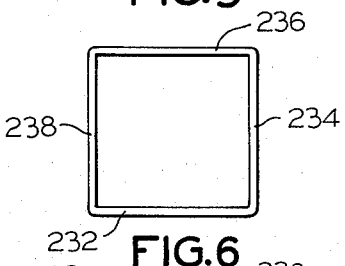
Figure 7:
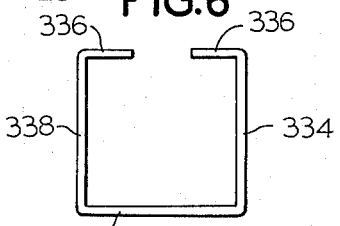

Post 52 may have front and rear walls 32 and 36 as well as side walls 34 and 38. Although the typical post 52 would include side walls such as walls 34 and 38, it will be apparent as the description proceeds that their presence is not critical to the functioning of the device. Nonetheless, they are considered desirable and would ordinarily be provided. Other post configurations that also employ side walls are illustrated in FIGS. 5, 6, and 7, which provide side walls 134 and 138, 234 and 238, and 334 and 338, respectively. The post of FIG. 5 illustrates a post construction of a common type, in which rear wall 136 has a vertical opening running along it. The posts of FIGS. 6 and 7 are square versions of those in FIGS. 2 and 5, respectively.

Mounting plate 22 includes two contiguous planar portions 20 and 26 lying in substantially perpendicular vertical planes, and rail 24 is welded to portion 26, extending perpendicularly from it. Mounting-plate portion 26 narrows to a tongue 28 whose purpose will be described further below.

Mounting-plate portion 20 is provided with vertically spaced apertures 18 that are spaced so as to allow them to be aligned with pairs of aligned holes 30 and 40 through front and rear walls 32 and 36 of post 52. These holes are aligned to receive upper and lower leg portions 44 and 48 of a generally U-shaped connector 50. Leg portions 44 and 48 are threaded at their free ends to provide threaded locking portions 42. These receive suitable nuts 14 that threadedly engage threaded portions 42 to bear against mounting-plate portion 20 through washers 16.

Figure 3:
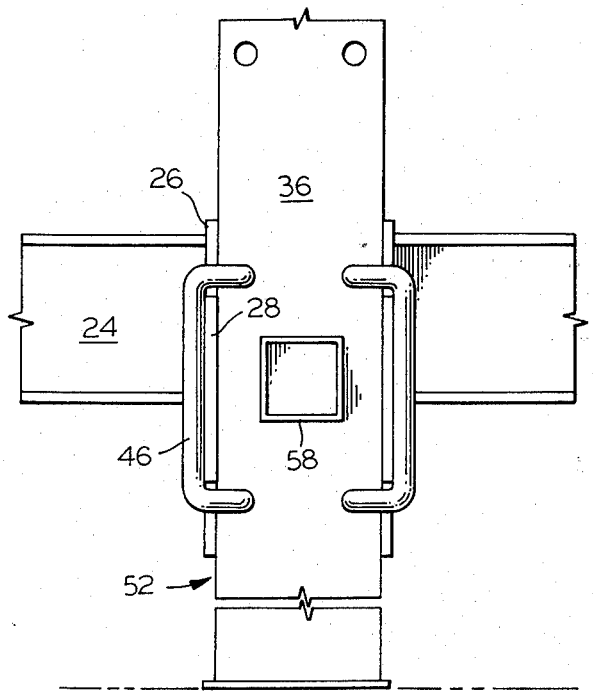
FIG. 3 is a rear elevation, with a part broken away, of the portion shown in FIG. 2.

Connector 50 also includes a laterally offset web portion 46 whose function is best described in connection with FIGS. 3 and 4. As FIG. 3 illustrates, offset web portion 46 leaves an opening between it and the edge margin of post 52. The vertical extent of this opening is not great enough to receive the full height of mounting-plate portion 26, but the narrowed tongue portion 28, which extends beyond wall 36, does fit in this opening and is held snugly against post 52 by connector web portion 46.

Figure 4:
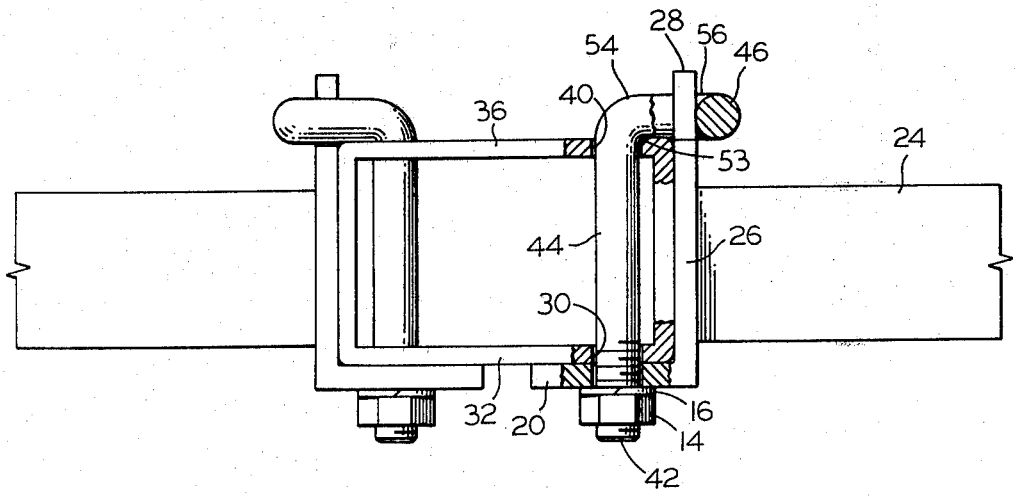
FIG. 4 is a plan view, partially broken away, of the same portion.

The assembled position is best seen in FIG. 4, which illustrates upper leg portion 44 extending through apertures 40 and 30 in post 52 and also through the upper aperture in mounting-plate portion 20. An offset portion 54 extending from the upper leg portion 44 is broken away in FIG. 4 to reveal a similar offset portion 56 extending from lower leg portion 48 and under tongue portion 28. Connector web portion 46 bears tightly against the exterior surface of mounting-plate tongue portion 28.

The manner in which rail 24 is assembled onto post 52 is apparent from the drawings; it is only necessary to align the apertures, insert the connector, and tighten the nuts.

With a proper spacing provided by connector web portion 46 and the edge margin of post 52, the force of connector 52 against mounting plate 22 will ordinarily be sufficient to prevent pivoting of rail 24 about the axis of post 52. This force can be enhanced, though, through the use of features similar to certain of those in the illustrated embodiment. These features can best be appreciated by referring to FIG. 4. With the construction shown in the drawings, it is possible for the force applied by nut 14 to be used both to establish the force on mounting-plate portion 26 and to apply force to mounting-plate portion 20. This can be accomplished in a number of ways, one of which is to provide a slight radius at the corner 53 afforded by offset portions 54 and 56. Such a radius would be effective to transmit force from nut 14 against tongue 28. As nut 14 is tightened, connector 50 tends to move forward, thus camming corners 53 along the edges of apertures 40 to move web portion 46 inward. In this way, the mechanical advantage of the threaded portions is initially employed to establish the force holding portion 26 of mounting plate 22 against post 52. At the same time, the tension on leg portions 44 and 48 is optimally effective in urging front mounting-plate portion 20 against post 52 because, since post 52 bears against connector offset portions 54 and 56, the connector tension is directly perpendicular to mounting-plate portion 20.

Of course, slight modifications could be made to the arrangement shown in the drawings in order to achieve the same effect. For instance, apertures 30, although essentially aligned with apertures 40, could be spaced from the edge of post 52 by a slightly greater distance that are apertures 40. This would cause a slight angle in legs 44 and 48, which would result in a leftward movement of connector web portion 46 upon tightening of nut 14.

Figure 10:
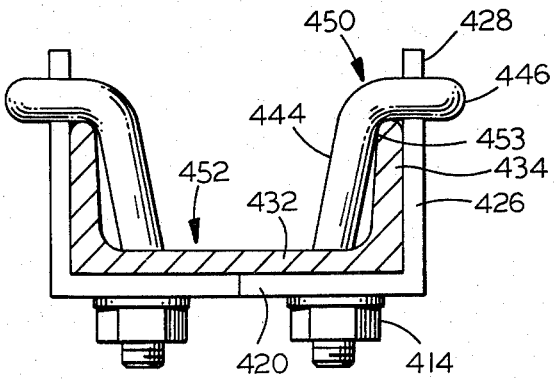
FIG. 10 is a sectional view taken at line 10–10 of FIG. 8.
Figure 8:
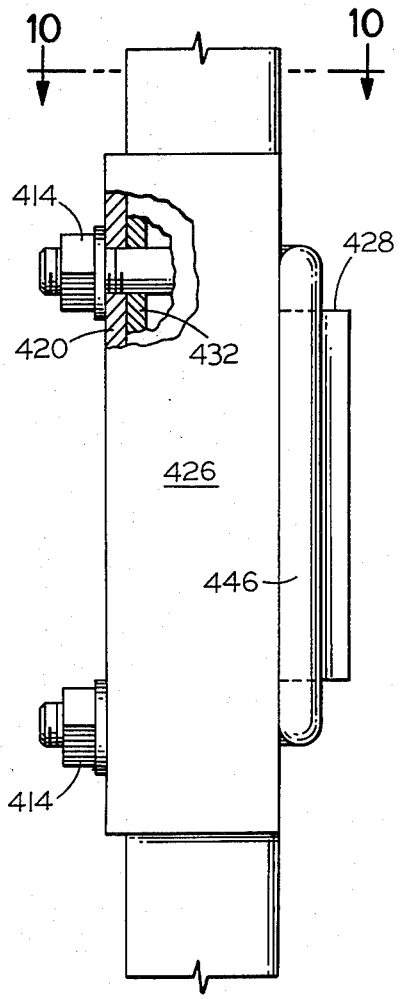
FIG. 8 is a side elevation of an alternative combination employing a three-walled post.
Figure 9:
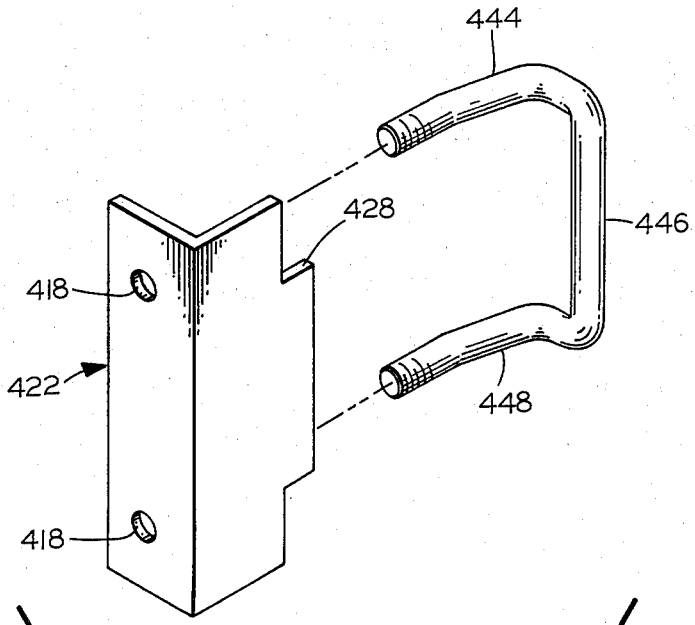
FIG. 9 is a perspective view of the U-shaped connector and mounting plate of the embodiment of FIG. 8.

A further embodiment of the present invention is illustrated in FIGS. 8, 9, and 10, in which a three-walled post 452 is employed. The functions of the several elements of the embodiment of FIGS. 8–10 are similar to those of correspondingly numbered elements in FIGS. 1–4. (Elements of FIGS. 8–10 differ in reference numberals from those in FIGS. 1–4 by the presence of the initial digit 4.)

The principle difference between the arrangement of FIGS. 8–10 and that of FIGS. 1–4 is the absence of a wall similar to wall 36 of FIG. 2 that provides a second set of openings through which the leg portions of the U-shaped connector can fit. Due to this difference, leg portions 444 and 448, although still providing substantially a right angle, are slightly inclined so that they bear against the inner surface of side wall 434. As a result of this arrangement, leg portions 444 and 448 are braced by wall 434 when web portion 446 applies force to the outer surface of tongue 428. Thus, side wall 434 performs in the arrangement of FIGS. 8–10 the function that was performed in the arrangement of FIGS. 1–4 by the edges of apertures 40 in wall 36 of FIG. 2.

Like the U-shaped connector of FIGS. 1–4, connector 450 of FIGS. 8–10 includes a radiused corner 453 to provide the camming action that is desirable during tightening of nuts 414.

It is apparent from the foregoing description that the structure described in the drawings provides a construction that is simple but very effective in achieving the desired rigidity. Mounting plate 22 only needs apertures in one of its two planar portions, yet holding force is applied against it in two dimensions. Connector 50 bears against opposite walls of post 52, so the component of force from nut 14 is maximized in the direction perpendicular to mounting-plate portion 20 even though the force of nut 14 can also be applied against mounting-plate portion 26. Thus, a superior storage-rack construction results from a simple mounting arrangement.

Having thus described the invention, we claim:

1. In a storage rack, the combination comprising:

a. a post having a vertically extending wall with at least one pair of vertically spaced apertures therethrough, said post also providing a vertical abutment surface in a plane perpendicular to that of said wall;

b. a rail extending horizontally from said post;

c. a mounting plate at the end of said rail adjacent said post, said mounting plate having contiguous first and second planar portions lying in substantially perpendicular vertical planes, each planar portion having an interior surface adjacent said post and an exterior surface, said first planar mounting-plate portion having its interior surface disposed against said first wall and having a pair of apertures aligned with said pair of apertures through said post wall, said rail extending from said exterior surface of said second mounting-plate portion, said interior surface of said second mounting-plate portion abutting said abutment surface on said post;

d. a generally U-shaped connector including a pair of substantially parallel leg portions extending horizontally through said pairs of apertures in said first mounting-plate portion and said post wall, each of said leg portions including a locking portion at the free end thereof extending exteriorly of said first mounting-plate portion, said connector further including a laterally offset web portion extending between said leg portions in a plane spaced from that of said post wall, said web portion extending substantially perpendicularly to said leg portions and beyond said abutment surface of said post to define an opening between said connector web portion and said post, said second mounting-plate portion including a tongue portion extending into said opening defined between said post and said connector web portion; and e. locking means engaged on said locking portions of said connector outwardly of said mounting-plate portion, abutting said exterior surface thereof, and holding the several elements in assembly, said connector web portion bearing against the exterior surface of said mounting-plate tongue portion when the several elements are in assembled position, said locking means thereby causing said connector web portion to hold said mounting-plate tongue portion against said abutment surface of said post to hold said rail rigidly in position on said post.

2. The combination of claim 1 wherein said post has a second vertically extending wall substantially parallel to said first-mentioned post wall and having a pair of apertures therethrough aligned with said apertures through said first post wall and said first mounting-plate portion, said leg portions of said U-shaped connector extending through said apertures through said second post wall, said web portion extending adjacent and exterior to said second post wall.

3. The combination of claim 2 wherein said post has a vertical side wall extending substantially perpendicularly between said first and second post walls to provide said abutment surface.

4. The combination of claim 2 wherein said locking portions of said connector are threaded and said locking means include nut means threadedly engaging said threaded locking portions.

5. The combination of claim 4 wherein said connector and mounting-plate tongue portion are dimensioned and configured for engagement of said mounting-plate tongue portion by said connector web portion throughout a range of protrusions of said connector locking portions from said mounting-plate apertures, the force of said web portion on said mounting-plate tongue portion through at least a part of said range increasing with the amount of protrusion of said locking portions of said connector from said first planar portion of said mounting plate, tightening of said nut means within said part of said range to increase the protrusion of said connector thereby increasing the force of said connector web portion on said mounting-plate tongue portion.

6. The combination of claim 1 wherein said post has a vertical side wall extending substantially perpendicularly from one edge margin of said post wall to provide said abutment surface.

7. The combination of claim 6 wherein said locking portions of said connector are threaded and said locking means include nut means threadedly engaging said threaded locking portions.

8. The combination of claim 7 wherein said connector and mounting-plate tongue portion are dimensioned and configured for engagement of said mounting-plate tongue portion by said connector web portion throughout a range of protrusions of said connector locking portions from said mounting-plate apertures, the force of said web portion on said mounting-plate tongue portion through at least a part of said range increasing with the amount of protrusion of said locking portions of said connector from said first planar portion of said mounting plate, tightening of said nut means within said part of said range to increase the protrusion of said connector thereby increasing the force of said connector web portion on said mounting-plate tongue portion.

9. The combination of claim 1 wherein said locking portions of said connector are threaded and said locking means include nut means threadedly engaging said threaded locking portions.

10. The combination of claim 9 wherein said connector and mounting-plate tongue portion are dimensioned and configured for engagement of said mounting-plate tongue portion by said connector web portion throughout a range of protrusions of said connector locking portions from said mounting-plate apertures, the force of said web portion on said mounting-plate tongue portion through at least a part of said range increasing with the amount of protrusion of said locking portions of said connector from said first planar portion of said mounting plate, tightening of said nut means within said part of said range to increase the protrusion of said connector thereby increasing the force of said connector web portion on said mounting-plate tongue portion.

11. In a method of assembling a storage rack, the steps of:

a. providing an elongated post having an elongated wall having at least one pair of longitudinally spaced apertures therethrough, said post also providing an abutment surface in a plane substantially perpendicular to that of said wall;

b. providing an elongated rail and a mounting plate at one end of said rail, said mounting plate having contiguous first and second planar portions lying in substantially perpendicular planes, said second planar portion providing a tongue portion, said rail extending perpendicularly in one direction from one surface of said second planar mounting-plate portion, said first planar mounting-plate portion extending in the other direction from the other surface of said second mounting-plate portion, said mounting plate being dimensioned and configured to receive the edge margin of said first post wall in the corner formed between said first and second planar mounting-plate portions with said first planar mounting-plate portion abutting said post wall and said other surface of said second planar mounting-plate portion abutting said abutment surface, said first planar mounting-plate portion including apertures therethrough positioned for alignment witn said apertures in said post wall when said post wall abuts said first mounting-plate portion with said post edge margin in the corner provided by said first and second planar mounting-plate portions;

c. providing a generally U-shaped connector including a pair of substantially parallel leg portions spaced and dimensioned to extend through said pair of apertures in said post wall and to further extend through said apertures in said first mounting-plate portion to provide a locking portion of said connector exterior to said first mounting-plate portion when said first mounting-plate portion abuts said post wall with its apertures aligned with said apertures in said post wall, said connector locking portions being threaded on the exterior surfaces thereof, said connector further including a web portion extending between said leg portions and being laterally offset to extend, when said leg portions are received in said apertures in said post wall, beyond said abutment surface of said post to define an opening between said connector web portion and said post sized to receive said mounting-plate tongue portion therein;

d. assembling said rail and mounting plate on said post with said post wall and said first mounting-plate portion in abutment with the apertures therein aligned and with said second mounting-plate portion abutting said abutment surface;

e. inserting said leg portions of said connector through said apertures in said post wall and said first planar mounting-plate portion to extend said connector locking portions exteriorly of said first planar mounting-plate portion, thereby providing the opening defined between said connector web portion and said post;

f. providing nut means threadedly engageable with said threaded locking portions of said connectors; and g. threadedly engaging said nut means on said locking portions and tightening them to urge said first mounting-plate portion against said first post wall and causing said connector web portion to bear against said tongue portion of said second planar mounting-plate portion on said surface thereof from which said rail extends, thereby fixing said rail rigidly in position on said post.

12. The method of claim 11 wherein said connector and mounting-plate tongue portion are dimensioned and configured for engagement of said mounting-plate tongue portion by said connector web portion throughout a range of protrusions of said connector locking portions from said mounting-plate aperture, the force of said web portion on said mounting-plate tongue portion through at least a part of said range increasing with the amount of protrusion of said locking portions of said connector from said first planar portion of said mounting plate, and wherein said step of tightening said nut means includes increasing the protrusion of said connector to increase the force of said connector web portion on said mounting-plate tongue portion.

* * * * *

UNITED STATES PATENT AND TRADEMARK OFFICE

CERTIFICATE OF CORRECTION

PATENT NO. : 4,366,910

DATED : January 4, 1983

INVENTOR(S) : SALVATORE A. UCCELLO ET AL

It is certified that error appears in the above—identified patent and that said Letters Patent is hereby corrected as shown below:

Column 7, line 17, before "mounting" insert -- first --

Column 8, line 57, "witn" should be -- with --

Signed and Sealed this

Ninth Day of August 1983

[SEAL]

*Attest:*

GERALD J. MOSSINGHOFF

*Attesting Officer*

*Commissioner of Patents and Trademarks*